US007128795B2

(12) United States Patent
Byrne et al.

(10) Patent No.: US 7,128,795 B2
(45) Date of Patent: Oct. 31, 2006

(54) METHOD AND APPARATUS FOR SPLICING A WEB MATERIAL

(75) Inventors: Thomas Timothy Byrne, West Chester, OH (US); Fredrick Edward Lockwood, Cincinnati, OH (US); Thomas Edward Franklin, Florence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 109 days.

(21) Appl. No.: 11/233,331

(22) Filed: Sep. 22, 2005

(65) Prior Publication Data

US 2006/0130961 A1 Jun. 22, 2006

Related U.S. Application Data

(62) Division of application No. 11/015,181, filed on Dec. 17, 2004.

(51) Int. Cl.
*B65H 21/00* (2006.01)

(52) U.S. Cl. ..... 156/159; 156/157; 156/502; 156/504; 156/505; 242/552; 242/553; 242/556

(58) Field of Classification Search ..... 156/157, 156/159, 502, 504, 505; 242/551, 552, 553, 242/556

See application file for complete search history.

(56) References Cited

U.S. PATENT DOCUMENTS

| | | | |
|---|---|---|---|
| 3,896,820 | A | 7/1975 | Ludszeweit et al. |
| 3,971,524 | A | 7/1976 | Nudinger et al. |
| 4,100,012 | A | 7/1978 | Meihofer et al. |
| 4,123,314 | A | 10/1978 | Sundin |
| 4,233,104 | A | 11/1980 | Fujishima et al. |
| 4,506,842 | A | 3/1985 | Beck |
| 4,948,061 | A | 8/1990 | Krimsky et al. |
| 4,995,936 | A | 2/1991 | Cohn |
| 5,190,234 | A | 3/1993 | Ezekiel |
| 5,253,819 | A | 10/1993 | Butler, Jr. |
| 5,474,252 | A | 12/1995 | Schmid |
| 5,618,377 | A | 4/1997 | Kaneko et al. |
| 5,692,698 | A | 12/1997 | Forbes |
| 5,697,575 | A | 12/1997 | Moore et al. |
| 5,698,060 | A | 12/1997 | Long |
| 5,709,355 | A | 1/1998 | Kinnunen et al. |
| 5,975,457 | A | 11/1999 | Forbes |
| 6,881,289 | B1 | 4/2005 | Borderi et al. |

FOREIGN PATENT DOCUMENTS

WO WO 2004/080869 A2 9/2004

*Primary Examiner*—Mark A. Osele
(74) *Attorney, Agent, or Firm*—Peter D. Meyer

(57) ABSTRACT

An apparatus and method for splicing web materials. The apparatus comprises a first nip roller, a second nip roller and an adhesive roller. The apparatus further comprises a first wind up roller and a second wind up roller. The apparatus also comprises a pair of infeed web cutting elements, and a pair of outfeed web cutting elements. First and second webs are received from upstream web supplies. One web proceeds downstream and the other is wound on a wind up roller. Adhesive is applied to one web and the two webs together with the adhesive pass between the nip rollers. One web is separated between the upstream supply and the splice and the other is separated between the splice and the wind up roller. The splice may proceed downstream.

8 Claims, 2 Drawing Sheets

METHOD AND APPARATUS FOR SPLICING A WEB MATERIAL

CROSS REFERENCE TO RELATED APPLICATION

This application is a divisional of U.S. application Ser. No. 11/015,181, filed Dec. 17, 2004.

FIELD OF THE INVENTION

The present invention relates to method and apparatus for splicing web materials. The invention relates particularly to methods and apparatus for splicing paper web materials.

BACKGROUND OF THE INVENTION

Web material are a ubiquitous part of modern life. Many web materials are processed into finished products used in a wide range of life aspects. The processing of web materials into products may include a process wherein the web material is unwound from a supply roll and subsequently processed to form at least a portion of a product. Due to the finite nature of any supply roll, it may be necessary to slow or stop the manufacturing process to replace an exhausted supply roll with a fresh roll of the web material. Slowing or stopping an otherwise continuous process for this purpose may be detrimental to process productivity and may adversely impact the costs associated with the manufacture of the finished product.

There may be a benefit to process productivity and the overall cost structure associated with producing a product from providing the web material in an uninterrupted fashion. Such an uninterrupted supply of web material may be accomplished through splicing the web material of a fresh roll to the web material of a nearly exhausted roll. The splicing of the web materials of the respective rolls may be accomplished at or near the desired production speed of the web handling process to reduce any impact upon the web handling process.

SUMMARY OF THE INVENTION

In one aspect the invention comprises an apparatus for the splicing of multiple web materials. The apparatus comprises a first nip roller, a second nip roller and an adhesive roller. The apparatus further comprises a first wind up roller and a second wind up roller. The apparatus also comprises a pair of infeed web cutting elements, and a pair of outfeed web cutting elements.

In another aspect the apparatus of the invention the first nip roller and the second nip roller may be adapted to splice the web materials without the use of a distinct adhesive roller.

In another aspect, the invention comprises a method for splicing multiple web materials. The method comprises steps of receiving a first web from an upstream web supply and receiving a second web from a second upstream web supply. The first web and the second web are routed through a nip formed by first and second nip rollers. The first web is routed to a downstream web handling process. The second web is wound around a wind up roll. The speed of the second web is matched to the speed of the first web. A rotatable adhesive roller is provided. Splicing tape is releasably attached to the adhesive roller. The adhesive roller forms a nip with the first nip roller. The first web passes through the nip formed by the adhesive roller and the first nip roller. The splicing tape is released from the adhesive roller and is fixedly attached to the first web. The splicing tape and first web pass through the nip formed by the first and second nip rolls together with the second web. The splicing tape is fixedly attached to the second web. The first web is cut upstream of the splicing tape. The second web is cut between the splicing tape and the second wind up roll. The spliced first and second webs proceed to the downstream process.

In this aspect of the invention, the handling of the first web and the second web may be alternated. In other words, the second web may initially be routed to a downstream process and the first web may be routed to a first wind up roll. The speed of the first web may be raised to match the speed of the second web. The splicing tape may be fixedly attached to either the first web or the second web prior to passing through the nip comprised of the first and second nip rollers. The first web may be cut between the splicing tape and the first wind up roll and the second web may be cut between the upstream supply and the splicing tape.

BRIEF DESCRIPTION OF THE DRAWINGS

While the claims hereof particularly point out and distinctly claim the subject matter of the present invention, it is believed the invention will be better understood in view of the following detailed description of the invention taken in conjunction with the accompanying drawings in which corresponding features of the several views are identically designated and in which:

DETAILED DESCRIPTION OF THE INVENTION

Figure 1:
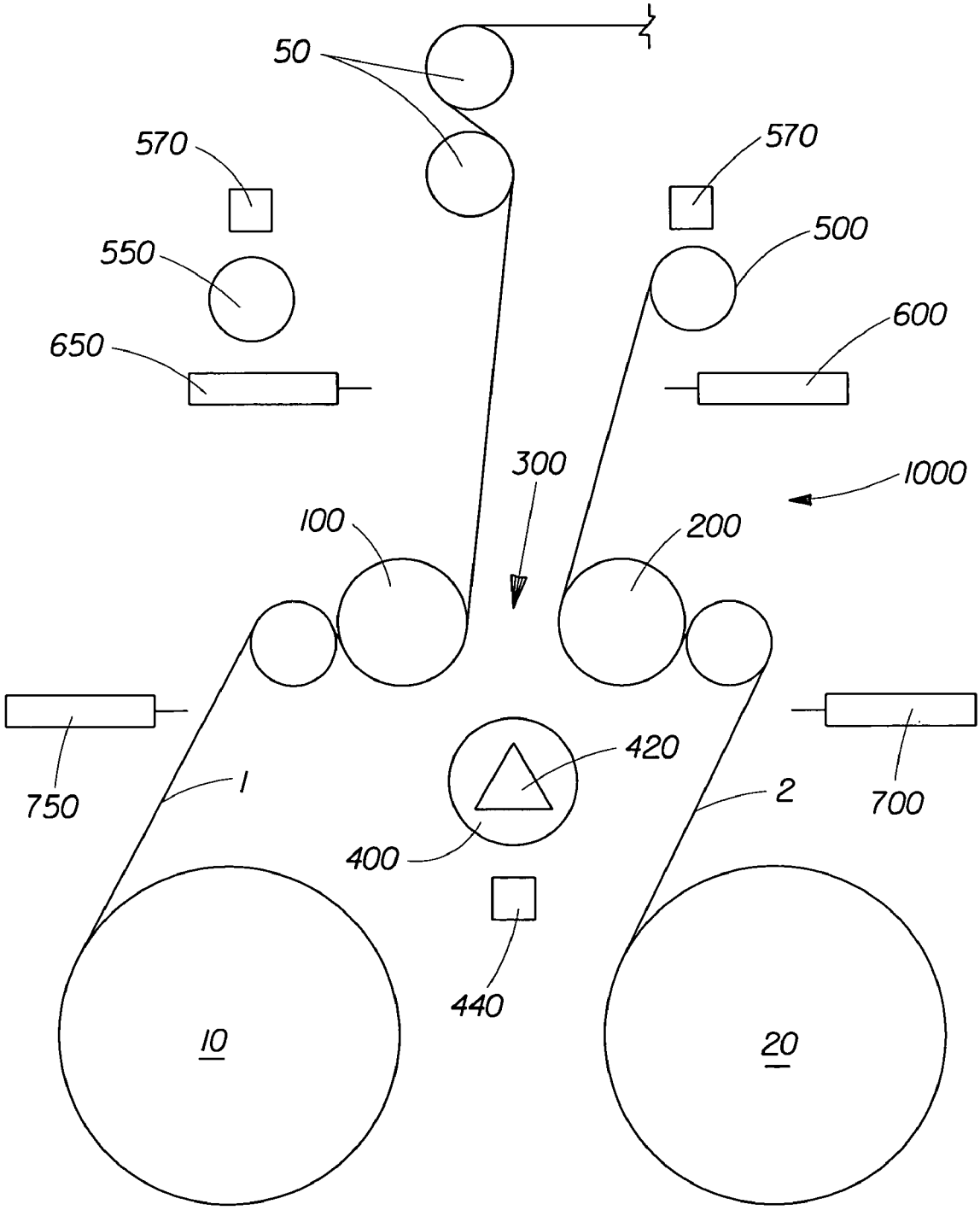
FIG. 1 shows a schematic view of a splicing apparatus according to one embodiment of the invention.

As shown in FIG. 1, a first web 1, and a second web 2, may be routed to the apparatus 1000 of the present invention from upstream web sources 10 and 20 respectively. Webs 1 and 2 may comprise any web material known in the art. Exemplary web materials include, without being limiting, non-woven web materials, paper webs including tissue, towel and other grades of paper, plastic films and metal films. The apparatus 1000 of the invention may be adapted to splice webs of practically any width and any thickness. Webs ranging in width from a few millimeters to about several meters may be processed by an appropriately sized splicing apparatus. Similarly, webs ranging in thickness from a few thousandths of a millimeter to several millimeters may be spliced by an appropriately adapted splicing apparatus 1000.

As used herein, splicing refers to the process of joining a first web material to a second web material. As used herein, a splice is considered to be the combined localized portions of the first web and second web that are joined together.

According to FIG. 1, the apparatus of the invention comprises a first nip roll 100 and a second nip roll 200. Each of the first nip roll 100 and second nip roll 200 may comprise a standard web handling roll adapted for the particular web material being spliced. In one embodiment, the nip rollers 100, 200, comprise carbon fiber roller shells attached to aluminum hubs. In another embodiment, the nip rollers 100, 200, may comprise either solid or hollow steel rollers. In some embodiments, the nip rollers 100, 200 may comprise urethane or other resilient surface coating. The nip rollers 100, 200, may have a flat surface or a crowned surface as these are known in the art. As a non-limiting example, the nip rollers may be crowned and covered with a urethane coating having a P&J hardness of between about 85 and about 90.

In one embodiment, the nip rollers 100, 200, comprise idler rolls. In this embodiment, the rollers 100, 200, turn only under the influence of the passing web materials 1 and 2 respectively. In another embodiment, at least one of the nip rollers 100, 200, comprise driven rollers. In this embodiment a power source is adapted to rotate at least one of the nip rollers 100, 200. The other nip roller may also be driven. The two nip rollers may be driven independently by being independently coupled to a single power source or by being coupled each to a separate power source. The nip rollers may be driven such that one roller is coupled to a power source and the other roller is coupled to the first roller. The nip rollers may be coupled to each other using roller link chains and sprockets, timing belts and pulleys, v-belts and sheaves, gears, and other coupling means known in the art.

The nip roller power source may comprise any motive source known in the art. Exemplary power sources include, without being limiting, standard and servo electric motors, air motors and hydraulic motors. The power source may be coupled to either or both of the nip rollers by any power transfer means known in the art. Exemplary power transfer means include, without being limiting, direct coupling the motor to the roller, driving the roller or rollers through the use of chains and sprockets, belts and sheaves, open or enclosed gearing and combinations of these.

In one embodiment the nip rollers 100, 200, may be configured such that the relative positions of nip rollers 100, 200, are fixed. In this embodiment, the nip roller 100, 200, form a nip 300 comprising a fixed gap or comprising a fixed nip pressure. In another embodiment, the nip rollers 100, 200, may be configured such that the relative positions of the nip rollers 100, 200 may be adjusted to provide a nip 300 comprising an adjustable nip gap and/or an adjustable nip pressure. The adjustment in the position of the nip rollers 100, 200 may be accomplished by any means known to those of skill in the art. Exemplary adjustment means include without being limiting, mounting either or both nip rollers 100, 200, on a slide mechanism and moving either or both nip rollers 100, 200, toward the other using a ball screw mechanism, a fluid powered cylinder, a rack and pinion mechanism, a cable and pulley system, a chain and sprocket system, linear moors, and combinations of these.

In one embodiment the position of the nip roller 100, 200, may be adjusted such that a small gap remains between the roller surfaces. In another embodiment the nip rollers 100, 200, may be adjusted such that there is a nip 300 between the rollers and such that the rollers 100, 200 press against each other at a desired nip pressure. In one embodiment the nip rollers 100, 200, may be adjusted to provide a pressure of about 10 psi (68,950 $N/m^2$). In another embodiment the nip rollers 100, 200 may be adjusted to a pressure of about 100 psi (689,500 $N/m^2$). In another embodiment the nip rollers may be adjusted to provide a nip pressure of 1000 psi (6,895,000 $N/m^2$). In still another embodiment, the nip rollers 100, 200, may be adjusted to provide a nip pressure of 10,000 psi (68,950,000 $N/m^2$). The desired nip pressure may vary depending upon the nature of the web materials being spliced and upon the joining method used to splice the web materials.

The webs 1, 2, are routed between the nip rollers 100, 200. The relative position of the nip rollers 100, 200, may be adjusted, as described above, as or after the webs 1, 2, are routed between the nip rollers 100, 200, or prior to the passage of the either or both of the webs 1, 2, between the nip rollers 100, 200.

As shown in FIG. 1, the first web 1 is routed through the nip 300 to a downstream web handling process (not shown). Web 2 is routed through the nip 300 and wraps second wind up roller 500. The second wind up roller 500 may be used to accelerate the second web 2 prior to splicing the second web 2 to the first web 1. Similarly, the first wind up roller 550 may be used to accelerate the first web 1 prior to splicing the first web 1 to the second web 2 when the second web 2 is routed to a downstream process (not shown). The first wind up roller 550 and the second wind up roller 500 may respectively accumulate the first web 1 and the second web 2 prior to splicing the two webs. In one embodiment, the spacing and configuration of the wind up rollers provides sufficient capacity to accumulate substantially an entire supply roll of the web material to be spliced.

Wind up roller diameter sensors 570 may be adapted to determine the diameter of the web accumulating on the wind up rollers 500 and 550. The output from the diameter sensors 570 may be processed by the controller (not shown) such that the speed of the wind up roller may be altered to achieve and maintain the desired web speed as the web is accumulating upon the wind up roller. In this manner the speed of the accumulating web may be matched to the speed of the web in process and the two webs may be more efficiently spliced by the apparatus 1000. The diameter sensors 570 may be comprise optical, mechanical, ultrasonic or other distance sensors as are known in the art.

In another embodiment the thickness of the web may be used together with an encoder coupled to a web handling roller such as the nip rollers 100, 200. In this embodiment the processor may calculate the accumulating circumference on the wind up roller 500, 550, and adjust the speed of the wind up roller according to the increase in the circumference to achieve and maintain the desired web speed prior to the splicing of the web materials. The processor may receive inputs from the encoder providing an indication of the actual web material length passed to the wind up roller and may use this length together with the known thickness to calculate the increase in the accumulated circumference.

Each of the first wind up roller 550 and the second wind up roller 500 may comprise a high friction web contacting surface to facilitate the initial adherence of the first web 1 or second web 2 to the respective roller 550, 500. In one embodiment, either or both of the wind up rollers 500, 550 may comprise an array of vacuum orifices coupled to a vacuum source to facilitate the initial adherence of the web material to the wind up roller.

The wind up rollers 500, 550 may be powered by any roller drive means known to those of skill in the art. The rollers may be coupled directly to a drive motor, indirectly coupled to a drive motor using a chain drive, gear drive, belt drive or gearbox as is known in the art. The roller may be coupled each to the other with one of the pair of wind up rollers also coupled to a drive unit.

In the example illustrated in FIG. 1, the second wind up roller 500 may accelerate the second web 2 to about the speed of the first web 1 moving toward the downstream process. As, or after, the speed of the second web 2 changes to match that of the first web 1, nip rollers 100 and 200 may be adjusted relative to each other to close any gap between the two rollers. Prior to the joining of web 1 to web 2, the two webs may pass between nip rollers 100 and 200 and the speed of the two webs may be substantially the same. The speed of nip rollers 100 and 200 may also be substantially the same as that of web 1 and web 2 as the webs pass through the nip 300 formed between nip rollers 100 and 200.

The relative motion of the first and second nip rollers 100, 200 may be profiled such that the gap between the nip rollers 100, 200 is closed at a constant rate. In one embodiment, the relative motion of the two nip rollers 100, 200, may be profiled such that the gap between the nip rollers 100, 200, is initially closed at a low rate and such that the final portion of the gap to be closed is closed rapidly relative to the initial portion of the gap. In this embodiment, the amount of time that the two webs 1, 2 are subjected to the nip pressure may be limited. It may be possible to reduce the duration of the exposure of the web materials 1, 2, to any deleterious effects related to the nip pressure. This reduction may be possible by creating the nip 300 rapidly at the time of the desired splice and also rapidly opening the gap between the first and second nip rollers 100, 200.

The splice between web 1 and web 2 may be accomplished by any means known in the art. The nature of the splice may be related to the nature of the particular web material being spliced. In one embodiment two webs are spliced together by using two-sided splicing tape having adhesive on each side of the tape. In this embodiment, the two-sided splicing tape is affixed first to one web and then to the second web. Pressure may be applied to the portion of the two webs after the application of the two-sided splicing tape.

In another embodiment paper webs may be joined by applying an adhesive directly to one web and then bringing the second web into contact with the adhesive. Pressure may be applied to the two webs at the location of the adhesive to assist in the joining of the webs.

In another embodiment the two webs may be brought into a face to face relationship and then subjected to sufficient nip pressure to bond the two webs together. In this embodiment, two paper webs may be subjected to sufficient nip pressure to glassine the two webs creating a bond sufficient to withstand the process tension applied to the spliced web.

In another embodiment the two webs may be brought into a face to face relationship and exposed to a bonding means. Exemplary bonding means include without being limiting, exposure to infra red or other electromagnetic radiation to heat and fuse the webs, ultrasonic energy applied from an appropriately adapted ultrasonic horn to the combined webs against an anvil to heat and fuse the webs, and the spray application of a solvent to fuse the webs.

Many of the above described embodiments may be performed using specifically adapted nip rollers. These nip rollers 100, 200, may be adapted to include spray nozzles, adhesive nozzles, radiation emitters and receivers, ultrasonic horns and anvils, and other means described above. Because the application of two-sided splicing tape necessarily requires access to a web face not in contact with either nip roller, an additional element must be added to apply the two-sided splicing tape for the splice.

An adhesive roller 400 may be disposed in a location upstream of the nip rollers 100, 200. The position of the adhesive roller 400 may be adjustable relative to the nip rollers 100, 200. The adjustable position of the adhesive roller 400 may enable the adhesive roller 400 to form a nip with either the first nip roller 100, the second nip roller 200, or both nip rollers 100, 200. The first web 1 may be routed such that the first web 1 will pass through a nip formed between the first nip roller 100 and the adhesive roller 400. The second web 2 may be routed such that the second web 2 will pass through a nip formed between the adhesive roller 400 and the second nip roller 200.

The position of the adhesive roller 400 relative to the nip rollers 100, 200, may be adjusted by any means known in the art. Exemplary means of adjusting the relative position of the adhesive roller include, without being limiting, linear bearings, slides, cams and cam followers, rack and pinions, ball screws, linear servo motors, roller link chains and sprockets, a timing belt and timing belt pulleys, and combinations thereof. The position of the adhesive roller 400 relative to the nip rollers may be monitored through the use of position sensors as are known in the art. As a non-limiting example, a linear position sensor coupled to the adhesive roller may provide a controller input related to the position of the adhesive roller relative to the nip rollers 100, 200. In one embodiment, Hall effect sensors may provide the relative position of the adhesive roller 400 with respect to the nip rollers.

The motion of the adhesive roller 400 with respect to the nip rollers 100, 200 may be controlled to allow the adhesive roller to interact with either the first web 1 or the second web 2. In other words, the adhesive roller may move to form a nip with the first nip roller 100 to place the two-sided splicing tape upon the first web during a first splicing operation. The adhesive roller 400 may subsequently move to form a nip with the second nip roller 200 to place the two-sided splicing tape upon the second web 2 in a subsequent splicing operation.

In one embodiment, the adhesive roller always moves to form a nip with the first nip roller 100 and always applies the two-sided splicing tape to the first web 1. In an alternative embodiment, the adhesive roller 400 always moved to form a nip with the second nip roller 200 and always applies the two-sided splicing tape to the second web 2.

The motion of the adhesive roller 400 relative to the nip rollers 100, 200, may be synchronized with the rotation of the adhesive roller 400. This synchronization may enable control of the interaction of the adhesive roller with the web 1 or web 2 so as to provide consistent placement of the two-sided splicing tape upon the web. The motion may be controlled such that the two-sided splicing tape is placed upon the web at a particular angular lag with respect to the nip between the nip rollers.

The lag of the placement of the two-sided tape placement is considered to be the angular displacement from the nip 300 to the nip between the adhesive roller 400 and the nip roller 100 or 200.

The adhesive roller 400 may comprise an idler roller or a driven roller coupled to an independent drive unit or coupled to one or more nip rollers 100, 200. In one embodiment, the adhesive roller may be coupled to another driven process roller (not shown).

The adhesive roller 400 may provide an adhesive for the splice as two-sided splicing tape or as a liquid or semi-solid adhesive. The two-sided splicing tape may be applied to the surface of the adhesive roll 400 and subsequently applied from the adhesive roller 400 to either the first web 1 or the second web 2. The adhesive roller 400 may be adapted to provide an adhesive directly to either the first web 1 or the second web 2. In such an embodiment, the adhesive may be applied to the exterior surface of the adhesive roller 400 and distributed to a substantially uniform coating by using an adhesive doctor blade as is known in the art. In another embodiment, the adhesive may be provided to the interior of a hollow adhesive roller 400 and may pass through a permeable shell to the outer surface of the adhesive roller 400. In such an embodiment, the permeability of the shell may be provided such that the adhesive presence on the outer surface of the adhesive roller is localized. In another embodiment, the adhesive presence on the outer surface of the adhesive roller 400 may be generalized to the entire surface of the roller.

The adhesive roller 400 may comprise a low energy surface coating to facilitate the release of a two-sided splicing tape. The adhesive roller 400 may comprise an internal vacuum manifold coupled to an array of vacuum orifices in the periphery of the adhesive roller. Two-sided splicing tape may be disposed substantially in alignment with the array of vacuum orifices such that vacuum applied through the orifices to the splicing tape may releasably hold the splicing tape against the adhesive roller 400. The adhesive roller 400 may comprise a low energy surface to facilitate the release of the two-sided splicing tape as desired.

The apparatus 1000 of the present invention may further comprise an adhesive roller encoder 420, to provide an indication of the rotary position of the adhesive roller 400. The apparatus may further comprise an adhesive roller home position sensor 440 to provide an indication that the adhesive roller is in a particular rotary position. Such a home position sensor 440 is well known to those of skill in the art. Such a home position sensor 440 may be used in conjunction with a home position flag affixed to the adhesive roller 400. The adhesive roller 400 may be driven by a stepper motor or by a servo motor or by other means. The control scheme of the apparatus may provide for selectively positioning the adhesive roller 400 at a particular rotary position based upon the indication provided by the adhesive roller encoder 420, the adhesive roller home position sensor 440, or both of these elements.

The adhesive roller 400 may be rotated to a particular position to facilitate the positioning of a portion of two-sided splicing tape along a particular portion of the periphery of the adhesive roller. As an example, the adhesive roller 400 may be rotated to and subsequently stopped in a home position to enable a machine operator or automated tape placement system to position a portion of two-sided splicing tape along an array of vacuum orifices disposed axially along a portion of the periphery of the surface of the adhesive roller 400.

The rotation of the adhesive roller may be driven subsequent to the application of the two-sided splicing tape to the adhesive roller 400 such that the surface speed of the adhesive roller 400 matches the speed of the first web 1 or the second web 2 or both the first web 1 and the second web 2. The position of the adhesive roller 400 relative to the first nip roller 100 or the second nip roller 200 may then be adjusted such that the rotation of the adhesive roller 400 will bring the two-sided splicing tape into contact with either the first web 1 or the second web 2 respectively.

The two-sided splicing tape may adhere to the web 1 or web 2 upon contacting the respective webs. The two-sided splicing tape may release from the adhesive roller 400 as the portion of the web to which the two-sided splicing tape is adhered moves downstream from the adhesive roller 400. In an embodiment comprising an array of vacuum orifices to assist in maintaining the contact between the two-sided splicing tape and the adhesive roller 400, the vacuum supply may be momentarily interrupted to facilitate the release of the two-sided splicing tape from the adhesive roller 400 as the two-sided splicing tape attempts to move downstream in attachment to the web 1 or web 2.

The combination of the two-sided splicing tape together with one of web 1 or web 2 moves through the nip formed by nip roller 1 and nip roller 2 together with the other of web 1 and web 2. As the combination of web 1, web 2, and the two-sided splicing tape moves through the nip 300, the two-sided splicing tape becomes attached to the other web as well as the web to which it was initially attached. The resulting combination of web 1, the two-sided splicing tape, and web 2, proceeds downstream from the nip 300.

According to FIG. 1, the second downstream web cutter 600 interacts with the second web 2 subsequent to the passage of the two-sided splicing tape through the nip 300. The first upstream web cutter 750 interacts with the first web 1 at a point upstream from the nip 300. The interaction of the upstream web cutter 750 may occur prior to or subsequent to the joining of the two webs in the nip 300. In one embodiment, the cutting of the web upstream of the nip 300 occurs before the first web 1 is joined to the second web 2. In this embodiment, the separation of the web prior to the joining of the two webs provides an opportunity to reduce the amount of web 1 material trailing the portion of web 1 that is joined to web 2.

As a result of these two interactions, the first web is cut between the two-sided splicing tape and the upstream supply, and the second web 2 is cut between the two-sided splicing tape and the second wind up roller 500. The first web and second web 2 joined to each other by the two-sided splicing tape proceed toward the downstream web handling process. As illustrated in the figure, the spliced web may proceed through a downstream s-wrap 50 toward the downstream process. The portion of the second web 2 wound upon the second wind up roller 500 is unwound from the second wind up roller 500. The remainder of the first web 1 present at the upstream supply is removed and replaced with a fresh roll of the web material.

Each of the downstream web cutters 600, 650, and upstream web cutters 700, 750, may comprise any means known in the art for cutting the particular web being spliced. As an example, any of the cutters may comprise a serrated cutting blade extending beyond the full width of the web material and driven along a reciprocating path such that the blade interferes with the path of the web material. The motion of the blade may be driven by a powered ball screw, a linear motor, an air cylinder or similar mechanism as is known in the art.

In one embodiment, the upstream and/or downstream web cutters may comprise a rotary cutter that separates the particular web portion through the interaction of a cutting blade moving along a substantially circular path with the web. Other web separating means known in the art such as laser beams, and water knives may also be used to separate the web materials upstream and downstream of the nip 300.

In one embodiment, the position of the cutting element relative to the target web may be indicated by an appropriate senor such as a linear position sensor. In this embodiment, the position of the blade may be controlled according to the input from the linear position sensor and an input from the adhesive roller position encoder 420 to cut the web material substantially at a desired position relative to the location of the two-sided splicing tape.

In this embodiment, the position of the two-sided splicing tape is determined by tracking the rotations of the adhesive roller 400 at the web speed after the transfer of the two-sided splicing tape from the adhesive roller 400 to the web 1. The motion of the respective cutting elements 600, 750 may then be timed to interact with the web material s at the desired location relative to the placement of the two-sided splicing tape.

Subsequent to the interaction of the cutting elements with the respective web materials, the relative positions of the nip rollers 100, 200 may be changed to open the gaps between the rollers. Similarly, subsequent to the transfer of the two-sided splicing tape from the adhesive roller 400 to the first web 1, the position of the adhesive roller 400 relative to the first nip roller 100 may be adjusted to open a gap between the rollers.

Figure 2:
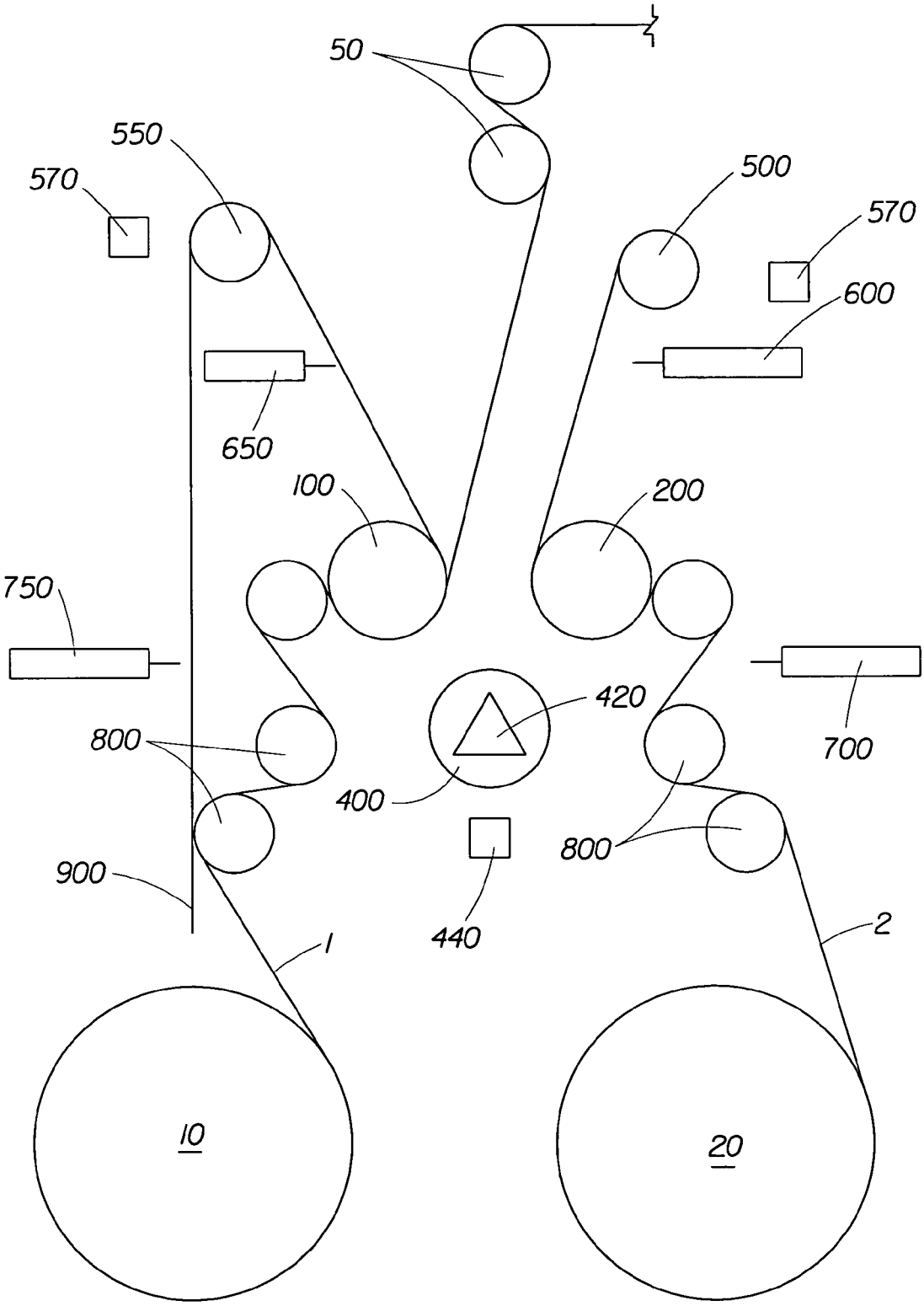
FIG. 2 illustrates a schematic view of a splicing apparatus according to another embodiment of then invention.

As shown in FIG. 2, s-wrap rollers 800 may be added to either or both web paths between the upstream web supplies and the splicing apparatus 1000. The addition of s-wrap rollers may provide a means of controlling the tension of each of the webs as the webs are routed into the splicing apparatus 1000.

As shown in FIG. 2, a thread up belt 900 may be used to facilitate the initial threading of a new web through the splicing apparatus 1000 prior to a splicing operation. A dual belt spot welded together at 18 inch (46 cm) intervals and routed along the path of the web materials may be used to carry the leading edge of the new web material from the upstream web supply through the splicing apparatus 1000 to the wind up roller.

In one embodiment, the adhesive roller may comprise one portion of a dual portion sealing system such as an ultrasonic horn and anvil combination or a radiant sealing system utilizing ultra violet, infra red, visible or other electromagnetic radiation passing from an emitter through the web material and subsequently into a receiver.

In an alternative embodiment, the joining of the web 1 and second web 2 may occur by the application of an adhesive adapted to adhere to each of the first and second webs. The adhesive may be applied by the use of an adhesive application roller, an adhesive extruder, one or more spray nozzles, a permeable web contacting surface, or other application means as are known in the art.

The illustrated splicing apparatus 1000 advantageously switches from a first web supply 10 to a second web supply 20, and back, without the accompanying need to move the supply roll of the web material from a new position to a running position. The ability to load a supply roll and unwind the roll without any necessary translational motion of the roll from a new position to a run position may enable additional stability and reliability in the unwind station mechanism.

In one embodiment, the splicing apparatus 1000 of the present invention may be configured such that the orientations of the first web 1 and the second web 2 are substantially vertical as the webs 1, 2, proceed through the splicing apparatus 1000. In another embodiment the splicing apparatus 1000 of the present invention may be configured such that the orientations of the webs 1, 2, are substantially horizontal as the webs 1, 2, proceed through the splicing apparatus 1000.

The splicing apparatus 1000 may be controlled by a single process controller or by a combination of process controllers collectively considered as an apparatus controller (not shown). In one embodiment the apparatus controller may receive data inputs from a variety of sensory input devices and may adjust apparatus output values according to an apparatus control program. Data may be provided relating to the speed of the first web 1, the second web 2, the first nip roller 100, the second nip roller 200, the adhesive roller 400, the first wind up roller 550, and the second wind up roller 500. Data relating the relative positions of the first and second nip roller 100, 200 as well as the relative position of the adhesive roller 400 to the first and second nip roller 100, 200 may be provided. The apparatus controller may also be provided with data relating the position of the upstream cutting elements and the downstream cutting elements relative to the first web 1 and second web 2. The rotary position of the adhesive roller or of the splicing element of a properly configured nip roller may be provided. The location of a portion of two-sided splicing tape or of a joined portion of the two webs relative to the upstream and downstream cutting elements may also be provided to the apparatus controller.

The downstream web handling may comprise any web handling process known to those of skill in the art. Exemplary web handling processes include, without being limiting, reminders, printers, embossing operations, laminating operations, slitting, folding and cutting operations and combinations of these.

EXAMPLE 1

A first supply roll of first paper towel substrate with a diameter of about 100 inches (254 cm) and a width of about 102 inches (260 cm) is placed upon a first unwind station with the winding axis of the supply roll in a vertical orientation. A portion of the leading edge of the substrate of the first supply roll is releasably attached to a first thread up belt. The thread up belt is routed to carry the first paper towel substrate through the splicing apparatus. The drive motor for the thread up belt is actuated and the belt carries the leading edge of the first paper towel substrate through the splicing apparatus as the fist unwind station rotates the first supply roll. The paper towel substrate is routed through a first pair of s-wrap rollers, past a first upstream web cutter, a first nip roller, a first downstream web cutter, and a first wind up roller. The leading edge of the first paper towel substrate is subsequently routed from the discharge of the splicing apparatus to downstream paper towel converting equipment. The first unwind station continues to rotate the fist supply roll. The first paper towel substrate unwinds from the first supply roll and proceeds through the splicing apparatus to the downstream paper towel converting process.

A second supply roll of paper towel substrate, substantially similar to the first supply roll, is placed upon a second unwind station. The winding axis of the second supply roll is also substantially vertical. The leading edge of the second paper towel substrate is releasably attached to a second thread up belt and is carried through the splicing apparatus by the second threaded up belt. The second paper towel substrate is routed through a second pair of s-wrap roller. The second paper towel substrate is routed past a second nip roller, a second upstream web cutter, a second downstream web cutter and is wrapped around a second wind up roller. The surface of each of the first wind up roller and second wind up roller is coated with a 10,015 high friction coating applied by Plasma Coating of TN, Inc., of Arlington, Tenn. This coating enables the leading edge of the second paper towel substrate to adhere to the second wind up roller. The second wind up roller rotates and winds up the second paper towel substrate proceeding from the second unwind station.

The speed of the second unwind station and the second wind up roller may be varied from zero to substantially about the speed of the first unwind station and the speed of the second paper towel substrate proceeding to the second wind up roller may be varied to match the speed of the first paper towel substrate proceeding to the downstream converting process.

When it is desirous or necessary to splice the second paper towel substrate to the first paper towel substrate, the speed of the second paper towel substrate may be matched to that of the first paper towel substrate. This may be accomplished by adjusting the speed of the second paper towel substrate to match the speed of the first paper towel substrate while maintaining the desired processing speed of the first paper towel substrate. As or after the speed of the first and second substrates is matched, the relative position of the first and second nip rollers may be adjusted such that any gap between the two nip rollers is reduced or eliminated. This adjustment in the relative positions of the nip rollers creates a nip. The first and second substrates pass together through this nip. The nip rollers are crowned and coated with an elastomeric coating to increase the resilience of the rollers. The pressure upon the substrates passing through the nip is adjusted by varying the spacing between the two nip rollers. Reducing the spacing increases the pressure upon the substrates.

The first paper towel substrate may be cut prior to being joined to the second paper towel substrate. The first upstream web cutter may interact with the first substrate and cut the substrate upstream from the nip rollers. Cutting the first substrate prior to the joining of the two substrates provides the opportunity to reduce the amount of the first substrate upstream of the splice location that must be carried away with the splice. Since this upstream portion, or tail, of material generally represents undesirable scrap and must be accounted for and removed from the downstream converting process, reducing the quantity of the tail is desirable.

A piece of 3M 906 two-sided splicing tape, available from the Minnesota Mining and Manufacturing Co., of Minneapolis, Minn., may be releasably attached to an adhesive roller. The surface of the adhesive roller may be coated with Dragon Elite 4 coating from Plasma Coatings of TN, Inc. of Arlington, Tenn. This surface coating may facilitate an easy release of the splicing tape from the roller and reduce the likelihood of the accumulation of adhesive from the tape to the roller. The adhesive roller may also comprise an array of orifices. A vacuum source coupled to the roller via a rotary union may provide a suction force at the array of orifices. The suction force may be applied to the splicing tape that is at least partially aligned with the array of orifices. The array may be sized to substantially correspond to the shape and size of the piece of splicing tape used to join the first paper towel substrate to the second paper towel substrate.

Placement of the two-sided splicing tape upon the surface of the adhesive roller may be facilitated by rotating the adhesive roller to a position where the array of orifices is easily accessible and subsequently stopping the rotation of the adhesive roller in this position. The two sided splicing tape may subsequently be placed in a position of substantial alignment with the array of orifices upon the surface of the adhesive roller. The suction force may be increased to assist in holding the two-sided splicing tape in the desired position. The backing which covers one side of the two-sided splicing tape may be removed from the two-sided splicing tape once the two-sided splicing tape has been releasably attached to the adhesive roller.

The adhesive roller may be rotated such that the surface speed of the adhesive roller matches that of the first and second paper towel substrates. The position of the adhesive roller relative to the nip rollers may be adjusted such that another nip is formed between the adhesive roller and at least one of the nip rollers. A nip pressure of 1000 psi (6,895,000 $N/m^2$ may be developed between the adhesive roller and the nip roller.

Depending upon the geometry of this nip, either the first substrate or the second substrate may pass through this nip. After the new nip is formed, the adhesive roller continues to rotate and the two-sided splicing tape comes into contact with the substrate passing through the nip and the two-sided splicing tape releases from the adhesive roller and adheres to the substrate. The vacuum applied to the two-sided splicing tape via the array of orifices in the surface of the adhesive roller may be reduced or eliminated to facilitate the transfer of the two-sided splicing tape from the adhesive roller to the substrate. The vacuum source may be switched off or an intervening control valve may be closed.

After the two-sided splicing tape transfers to the paper towel substrate the position of the adhesive roller relative to the nip rollers is adjusted to open a gap between the adhesive roller and the nip roller or rollers. The adhesive roller is decelerated and stopped in a rotary position that enables the positioning of the two-sided splicing tape for the next splice in alignment with the array of vacuum orifices.

The combination of the substrate and the two-sided splicing tape moves through the nip between the nip rollers together with the other substrate. The proximity of the nip rollers or the pressure of the nip causes the two-sided splicing tape to adhere to both substrates and the splice—the combination of the two substrates joined by the two-sided splicing tape—exits the nip formed by the nip rollers. After the splice has been formed and has exited the nip formed by the nip rollers the relative position of the nip rollers is adjusted to open a gap between the nip rollers. The gap is large enough that the first and second substrates pass through the gap without contacting each other.

Once the splice has been formed the second paper towel substrate may be cut between the splice and the wind up roller. The second downstream web cutter interacts with the substrate and cuts the substrate between the splice and the second wind up roller. The downstream portion of the substrate between the splice and the cut is generally considered to be scrap material. This scrap material generally must be accounted for in the downstream converting process. Reducing the amount of this scrap is generally desirable. The amount of the scrap may be reduced by tracking the position of the splice and cutting the second paper towel substrate as close to the downstream edge of the splice as possible.

After the second substrate has been cut, the wind up roller is decelerated and the portion of the second substrate wound up on the roller prior to the cut is removed. The removal of this portion of the second substrate may be accomplished by manually unwinding the substrate from the second wind up roller, or by reversing the rotation of the roller to unwind the substrate.

The first supply roll may be decelerated to a full stop from the substrate processing speed after the first substrate has been cut. The first supply roll may then be removed from the first unwind station and a new supply roll may be situated upon the first unwind station. Once the new roll has been situated upon the first unwind station, the paper towel substrate of the new roll may be spliced to the second paper towel substrate from the second supply roll.

Once it is necessary or desirable to splice the new first substrate to the second substrate, the above described process is performed again. The formation of the splice follows substantially the same steps with only minor variations. The new first web is releasably attached to a first thread up belt and fed through the splicing apparatus to the first wind up roller. The speed of the new first substrate is increased until the speed matches the speed of the second substrate. The gap between the nip rollers is reduced at least until the first and second substrates contact each other. The second substrate is cut upstream of the nip. The nip between the adhesive roller and one or more of the nip rollers is formed and the two-sided splicing tape is transferred from the adhesive roller to one of the substrates. The two substrates and the two-sided splicing tape pass together through the nip between the nip rollers forming the splice. The positions of the adhesive roller and the nip rollers are adjusted to open gaps between the rollers. The new first substrate is cut downstream from the splice and the spliced substrate proceeds toward the downstream converting process.

All documents cited in the Detailed Description of the Invention are, in relevant part, incorporated herein by reference, the citation of any document is not to be considered as an admission that it is prior art with respect to the present invention.

While particular embodiments of the present invention have been illustrated and described, it would have been obvious to those skilled in the art that various other changes and modifications can be made without departing from the spirit and scope of the invention. It is therefore intended to cover in the appended claims all such changes and modifications that are within the scope of the invention.

What is claimed is:

1. A method for splicing a first web and a second web, the method comprising steps of:

a) providing a first web at a first speed from a first upstream web supply, b) providing a second web at a second speed from a second upstream web supply, c) routing the first web around a first nip roller, d) routing the second web around a second nip roller, e) winding the second web on a wind up roller downstream of the second nip roller at a speed substantially equal to the first speed, f) forming a first nip between the first nip roller and the second nip roller wherein the first web and the second web pass through the nip in face-to-face contact with the other, g) rotating an adhesive roller comprising a circumferential surface and a portion of a two-sided splicing tape releasably attached to the circumference such that the speed of the circumference is substantially equal to the first speed, h) transferring the two-sided splicing tape from the adhesive roller to the first web upstream from the first nip, i) routing the first web and the second web through the first nip wherein the two-sided splicing tape is disposed between the first web and the second web, j) cutting the second web between the two-sided splicing tape and the second wind up roller by using a downstream web cutter, and k) cutting the first web between the first upstream web supply and the first nip by using a downstream web cutter.

2. The method according to claim 1 wherein the portion of two-sided splicing tape is releasably attached to the adhesive roller circumference by applying a vacuum through at least one vacuum orifice to the portion of two-sided splicing tape.

3. The method according to claim 1 further comprising a step of routing the second web from the upstream web supply past the second nip roller and to the wind up roller using a web threading belt.

4. The method according to claim 1 further comprising a step of initially attaching the second web to the wind up roller using a wind up roller high friction web contacting surface.

5. The method according to claim 1 further comprising a step of routing the first web through a pair of s-wrap rollers between the upstream web supply and the first nip.

6. The method according to claim 1 further comprising the step of determining the rotary position of the adhesive roller.

7. The method according to claim 1 further comprising the step of adjusting the position of the downstream web cutter according to the rotary position of the adhesive roller.

8. The method according to claim 1 further comprising the step of adjusting a relative position of the adhesive roller and the first nip roller according to the rotary position of the adhesive roller.

* * * * *

UNITED STATES PATENT AND TRADEMARK OFFICE

CERTIFICATE OF CORRECTION

PATENT NO. : 7,128,795 B2
APPLICATION NO. : 11/233331
DATED : October 31, 2006
INVENTOR(S) : Byrne et al.

It is certified that error appears in the above-identified patent and that said Letters Patent is hereby corrected as shown below:

Col. 10, line 10, the word "reminders" should be --rewinders--

Signed and Sealed this

Twenty-seventh Day of February, 2007

JON W. DUDAS
*Director of the United States Patent and Trademark Office*